United States Patent [19]

Brandt

[11] Patent Number: 4,547,983

[45] Date of Patent: Oct. 22, 1985

[54] BICYCLE SHOE

[75] Inventor: Jobst Brandt, Palo Alto, Calif.

[73] Assignees: Bernhard Hoffacker, Woodside; Neal Hoffacker, Portola Valley, both of Calif.

[21] Appl. No.: 467,827

[22] Filed: Feb. 18, 1983

[51] Int. Cl.[4] ..... A43B 5/14

[52] U.S. Cl. ..... 36/131; 36/113; 36/58.6

[58] Field of Search ..... 36/92, 113, 114, 129, 36/131, 69, 76 HH, 58.5, 58.6

[56] References Cited

U.S. PATENT DOCUMENTS

| | | | |
|---|---|---|---|
| 588,038 | 8/1897 | Tudor | 36/131 X |
| 1,018,708 | 2/1912 | Hetrick | 36/113 X |
| 2,045,066 | 6/1936 | Bower | 36/113 X |
| 2,994,972 | 8/1961 | Blair | 36/113 X |
| 3,015,896 | 1/1962 | Breslow | 36/58.6 |
| 3,138,880 | 6/1964 | Kunzli | 36/114 |
| 3,812,606 | 5/1974 | Merola | 36/131 X |
| 4,236,328 | 12/1980 | Friedlander | 36/58.5 |

FOREIGN PATENT DOCUMENTS

| | | | |
|---|---|---|---|
| 29192 | 5/1981 | European Pat. Off. | 36/131 |
| 2432970 | 4/1980 | France | 36/131 |
| 289051 | 2/1953 | Switzerland | 36/129 |

*Primary Examiner*—Werner H. Schroeder
*Assistant Examiner*—T. Graveline
*Attorney, Agent, or Firm*—Limbach, Limbach & Sutton

[57] ABSTRACT

An improvement to a shoe primarily adapted for use in bicycling comprising a substantially non-elastic strap extending from a location proximate the upper heel of the shoe and extending substantially to the sole at a location proximate the ball of the foot to prevent stretching of the shoe from upward thrust during pedaling.

7 Claims, 2 Drawing Figures

BICYCLE SHOE

TECHNICAL FIELD OF INVENTION

Sports enthusiasts have become increasingly aware of the necessity for selecting footwear particularly adapted for use in a specific sport. For some time, runners have selected various styles of shoes not only for enhanced aesthetic appeal but also, and more importantly, to provide a construction to enhance performance. The same is true for footwear employed by cyclists.

BACKGROUND OF THE INVENTION

Prior to the present invention, cycling footwear, although particularly adapted for engagement by the pedal and pedal cage have not been particularly well designed to accommodate the unique stresses placed upon the shoe during the entire pedal rotation. For example, the bicycle pedal is caused to rotate in a cyclical motion while propelling the bicycle. The entire motion consists of a downward thrust impressed upon the pedal surface by the sole of the shoe between the 12:00 and 6:00 positions and an upward thrust urged against the pedal cage by the cleat of the shoe between the 6:00 and 12:00 positions. It is this later half of the pedal cycle which has been grossly overlooked in the design of the present day cycling shoes resulting in certain dimensional losses which can be regained through the practice of the present invention.

It is thus an object of the present invention to provide a shoe primarily adapted for use in bicycling which is free from the disadvantage of prior art cycling shoes.

It is yet another object of the present invention to provide a shoe primarily adapted for use in bicycling wherein the upward thrust of the shoe during the pedaling cycle can cause the shoe to undergo dimensional deformation.

These and other objects of the present invention will be more fully appreciated when considering the following disclosure and appended drawing which illustrates the shoe of the present invention in functional engagement with a cycle pedal.

SUMMARY OF THE INVENTION

The present invention deals with a shoe primarily adapted for use in bicycling. The improvement comprises a substantially non-elastic strap extending from a location proximate the upper heel of the shoe and extending substantially to the sole at a location proximate the ball of the foot. When used herein, the term "non-elastic" is intended to imply a material which is at least less elastic than the surrounding shoe uppers.

DETAILED DESCRIPTION OF THE INVENTION

Figure 1:
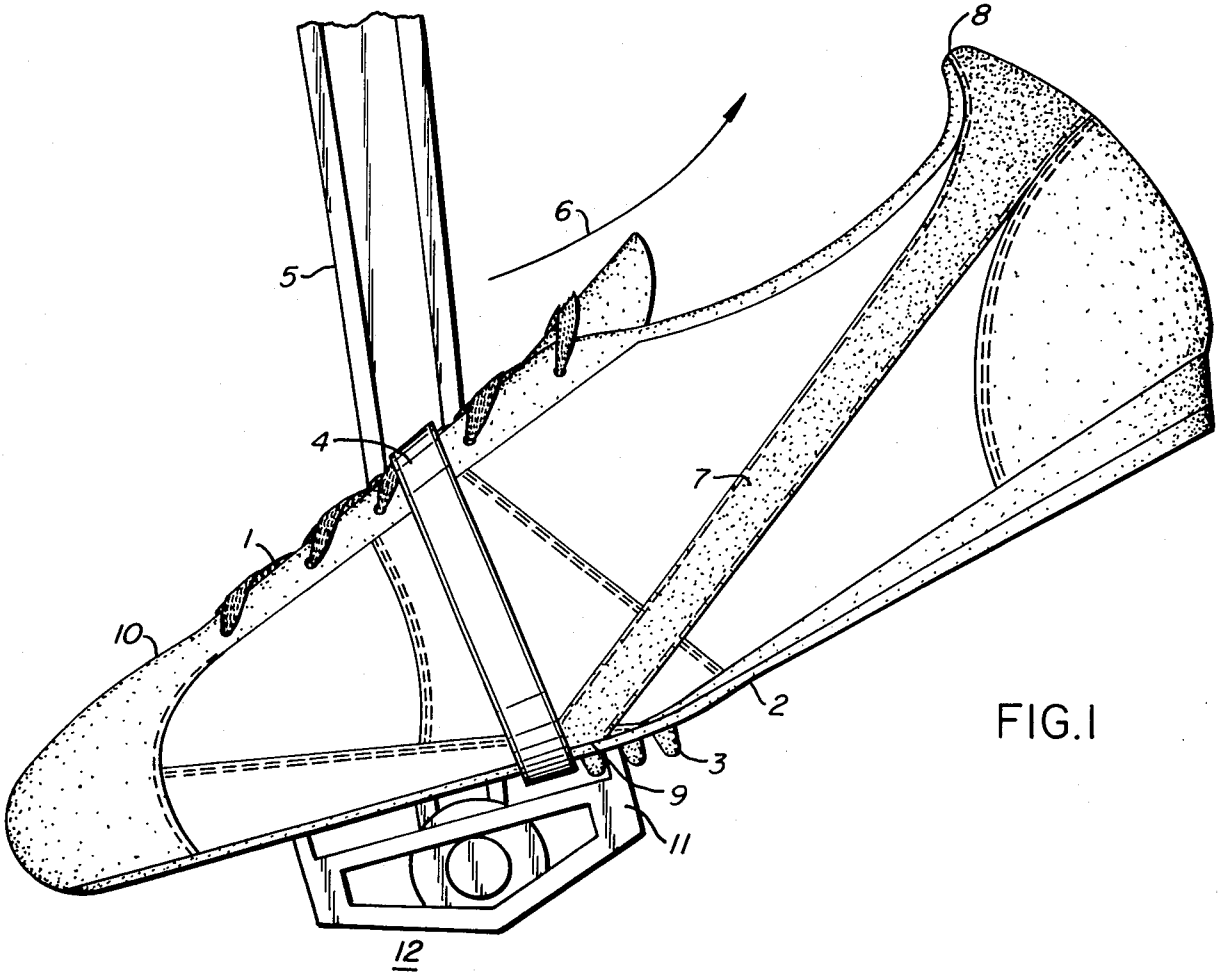
FIG. 1 illustrates the overall embodiment of the invention showing the general location of the non-elastic strap.
Figure 2:
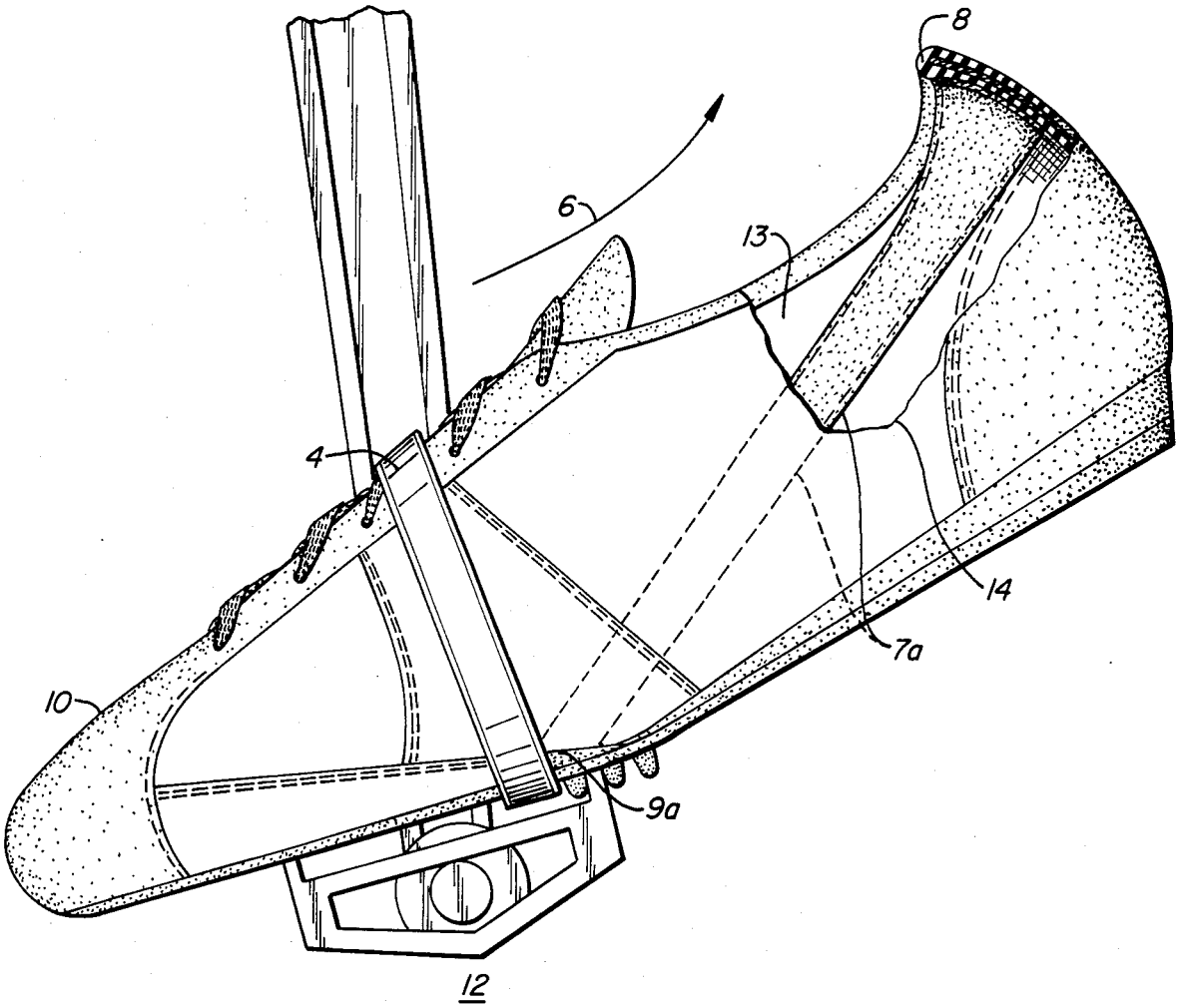
FIG. 2 illustrates a further embodiment of the invention wherein the non-elastic strap is illustrated as an internal part of the shoe's structure.

Turning now to the appended FIGS. 1 and 2, shoe 10 is shown in functional contact with cycle pedal 12 which engages crank 5 which, in turn, is connected to the drive mechanism of a cycle (not shown). If thought of as the face of a clock, shoe 10 fitting to the pedal cage moves in a cyclical motion as schematically shown by arrow 6. Between the 12:00 and 6:00 positions, sole 2 of shoe 10 presses against the engaging surface of pedal 12 being retained in position by pedal strap 4 and cleat 3. It is this segment of the cycle which results in the generation of a majority of the power to the crank and it is thus this portion of the cycle which has proved of interest to prior shoe designers.

However, as the power cycle continues, the top or lace surface 1 of shoe 10 presses upwardly against pedal strap 4 which surrounds the shoe in the area known as the ball of the foot. It has been discovered that a significant fraction of the overall power transmitted to crank 5 is done during this second half of the pedaling cycle and it is therefore incumbent to design a cycling shoe which maximizes this upward thrust and resists elongation resulting from the upward and rearward thrust of the foot.

The present invention differs from prior art cycling shoes by providing substantially non-elastic strap 7 extending from location 8 which is proximate the upper heel of the shoe to a location 9 proximate the ball of the foot. It is noted that location 9 is the point where pedal strap 4 and cleat 3 form a vertex. As such, when the foot is pulling upon pedal cage 11 between the 6:00 and 12:00 positions, non-elastic strap 7 provides a line of force between upper heel 8 and ball 9 which enables the foot to exert power during the upward and rearward thrust which is undissipated by the flexibility of the shoe, generally.

The beneficial results achieved through the use of substantially non-elastic strap 7 can be realized whether said strap is located interiorally of the shoe, that is, on its inner surface, between the inner and outer cushions of the shoe or even on the shoe's exterior surface. Further, although said strap is shown being stitched to the shoe as a continuous body beginning from the inner side of the shoe continuing around proximate top edge 8 and terminating substantially at the sole on the shoe's outer side at 9, the beneficial results inherent in practicing the present invention can be realized by providing two discontinuous straps each extending on respective sides of the shoe substantially from upper heel area 8 and terminating at ball 9.

The material employed for use as strap 7 must be substantially non-elastic. This means that although some elasticity may appear in the strap, the elasticity must be substantially less than the elasticity of the surrounding fabric uppers. As an example of an ideal material, non-stretch nylon sheeting can be employed.

FIG. 2 further illustrates the invention in its most preferred embodiment wherein non-elastic strap **7*a* is made an internal part of the structure of shoe 10. Non-elastic strap 7*a* is constructed internally to shoe 10 between internal shoe cushion 13 and external shoe cushion 14. As was pointed out in FIG. 1, strap 7*a* extends continuously from the upper heel portion 8 of shoe 10 diagonally along the side of shoe 10 to an area of the shoe which corresponds to the ball of the cyclist's foot where strap 7*a* is anchored to the sole of shoe 10**.

It will be recognized that the specific forms of the invention herein illustrated and described are intended to be representative only, and certain changes may be made therein without departing from the clear teachings of the disclosure. Accordingly, reference should be made to the following appended claims in determining the full scope of the invention.

I claim:

1. In a shoe primarily adapted for use in bicycling, the improvement comprising a substantially non-elastic strap extending from a location proximate the upper heel of the shoe and extending substantially to the sole of the shoe at a location proximate the area of said shoe corresponding to the ball of the cyclist's foot, said strap further being anchored to said shoe at the region of said sole which is located above the pedal of the bicycle when the shoe is placed onto the bicycle pedal.

2. The shoe of claim 1 wherein said strap comprises non-stretch nylon sheeting.

3. The shoe of claim 1 wherein said strap is continuously extending substantially from the sole of the inner side of the shoe where the strap is anchored to said inner side of the shoe at the region of the shoe which is located above the pedal when the shoe is placed onto the pedal, continuing around proximate the top edge of the shoe at the heel and terminating substantially at the sole of the other side of the shoe where said strap is similarly anchored to the shoe at the region of said other side of the shoe located above the pedal.

4. The shoe of claim 1 or 3 wherein said strap is internal to the structure of said shoe.

5. The shoe of claim 4 further comprising inner and outer cushions and wherein said strap is located between said inner and outer cushions.

6. The shoe of claim 4 wherein said strap is located on the inner surface of the shoe.

7. In a shoe primarily adapted for use in bicycling, wherein use is made of a pedal having a toe strap, the improvement comprising a substantially non-elastic strap extending from a location proximate the upper heel of the shoe and extending to the sole of the shoe at a location along the sole of said shoe which corresponds to the point at which the area of said shoe corresponding to the ball of the cyclist's foot contacts said toe strap, said non-elastic strap being anchored to said shoe at the region of said shoe corresponding to the point at which said toe strap contacts said pedal, such that during pedaling said toe strap cooperates with said non-elastic strap to prevent said shoe from being pulled away from said pedal.

* * * * *